US012752899B2

(12) United States Patent
Ikegaya

(10) Patent No.: US 12,752,899 B2
(45) Date of Patent: Oct. 6, 2026

(54) WATERCRAFT PROPULSION SYSTEM, AND WATERCRAFT

(71) Applicant: YAMAHA HATSUDOKI KABUSHIKI KAISHA, Iwata (JP)

(72) Inventor: Yuji Ikegaya, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 382 days.

(21) Appl. No.: 18/379,207

(22) Filed: Oct. 12, 2023

(65) Prior Publication Data

US 2024/0132193 A1 Apr. 25, 2024
US 2024/0228003 A9 Jul. 11, 2024

(30) Foreign Application Priority Data

Oct. 19, 2022 (JP) ..... 2022-167328

(51) Int. Cl.
*B63H 21/21* (2006.01)
*B63B 45/04* (2006.01)
*B63H 21/17* (2006.01)

(52) U.S. Cl.
CPC ..... *B63H 21/21* (2013.01); *B63B 45/04* (2013.01); *B63H 21/17* (2013.01); *B63H 2021/216* (2013.01)

(58) Field of Classification Search
CPC .. B63H 21/21; B63H 21/17; B63H 2021/216; B63B 45/04
See application file for complete search history.

(56) References Cited

U.S. PATENT DOCUMENTS 5,722,864 A * 3/1998 Andiarena ..... B63H 23/24 440/5
7,497,748 B2 3/2009 Salmon
2013/0039081 A1 2/2013 Czipri et al.
2013/0115832 A1* 5/2013 Suzuki ..... B63H 21/20 440/6
2020/0086959 A1 3/2020 DeBilt

FOREIGN PATENT DOCUMENTS

DE 10 2012 005 351 A1 9/2013

OTHER PUBLICATIONS

Official Communication issued in corresponding European Patent Application No. 23202889.4, mailed on Apr. 9, 2024.

* cited by examiner

*Primary Examiner* — Aryan E Weisenfeld
(74) *Attorney, Agent, or Firm* — Keating & Bennett, LLP

(57) ABSTRACT

A watercraft propulsion system includes an electric propulsion device attachable to a hull, an indicator located above a draft line of the hull and operable to indicate to surroundings of the electric propulsion device information about the state of the electric propulsion device, and a controller. The controller has a plurality of control modes including an electric propulsion device enabled mode in which the electric propulsion device is enabled to be driven, and is configured or programmed to perform an indicator control operation in the electric propulsion device enabled mode to actuate the indicator to indicate that the electric propulsion device is in a drivable state.

11 Claims, 13 Drawing Sheets

FIG. 11

| | | | Propulsion device mode | | | |
|---|---|---|---|---|---|---|
| | | | Engine mode | Dual mode | Electric mode | Extender mode |
| Watercraft maneuvering mode | Ordinary mode | | Unlight | Unlight | | |
| | Joystick mode | Ordinary joystick mode | Unlight | Light | Light | Light |
| | | Joystick hold mode | Unlight | Unlight | Light | Light |
| | | Joystick hold/ autopilot combination mode | Unlight | Unlight | Light | Light |
| | Holding mode | STAY POINT | Light (blink) | Light (blink) | Light (blink) | Light (blink) |
| | | FISH POINT | Light (blink) | Light (blink) | Light (blink) | Light (blink) |
| | | DRIFT POINT | Light (blink) | Light (blink) | Light (blink) | Light (blink) |

WATERCRAFT PROPULSION SYSTEM, AND WATERCRAFT

CROSS REFERENCE TO RELATED APPLICATIONS

This application claims the benefit of priority to Japanese Patent Application No. 2022-167328 filed on Oct. 19, 2022. The entire contents of this application are hereby incorporated herein by reference.

BACKGROUND OF THE INVENTION

1. Field of the Invention

The present invention relates to a watercraft propulsion system, and a watercraft including the watercraft propulsion system.

2. Description of the Related Art

US 2013/115832 A1 discloses a watercraft propulsion device of a hybrid type configured so that a propeller having blades fixed inward of a tubular rim is driven by an engine and an electric motor. The propeller is surrounded by a duct, and is rotated with respect to the duct. The watercraft propulsion device disclosed in US 2013/115832 A1 further includes an illuminator provided on the propeller or the duct to emit light when the propeller is rotated (see FIGS. 24 and 26 in US 2013/115832 A1).

SUMMARY OF THE INVENTION

The inventor of preferred embodiments of the present invention described and claimed in the present application conducted an extensive study and research regarding a watercraft propulsion system, such as the one described above, and in doing so, discovered and first recognized new unique challenges and previously unrecognized possibilities for improvements as described in greater detail below.

In the configuration of US 2013/115832 A1, the propeller and the duct are located in the water to generate a propulsive force, so that the illuminator emits light in the water. Therefore, there is room for improvement in order to more easily recognize the illuminator by the user of another watercraft sailing there behind.

In the case of the hybrid-type watercraft propulsion device of US 2013/115832 A1, surrounding people can easily recognize a propeller rotating state and a propeller rotatable state from the operation sound and the vibrations of the engine if the engine is in operation.

However, the operation sound and the vibrations are small when the hybrid-type propulsion device is in an engine stop state or when an electric propulsion device including no engine is in operation. Therefore, it is particularly difficult to let the surrounding people know, from the operation sound or the vibrations, that the propulsion device is in a standby state with its power supply turned on.

In view of the foregoing, preferred embodiments of the present invention provide watercraft propulsion systems and watercraft in each of which, not only the electric propulsion device driving state, but also the electric propulsion device drivable state are communicated to the surroundings.

In order to overcome the previously unrecognized and unsolved challenges described above, a preferred embodiment of the present invention provides a watercraft propulsion system including an electric propulsion device attachable to a hull, an indicator located above a draft line of the hull and able to indicate to surroundings of the electric propulsion device information about the state of the electric propulsion device, and a controller. The controller includes a plurality of control modes including an electric propulsion device enabled mode in which the electric propulsion device is enabled to be driven, and is configured or programmed to perform an indicator control operation in the electric propulsion device enabled mode to actuate the indicator to indicate that the electric propulsion device is in a drivable state.

With this arrangement, when the controller is in the electric propulsion device enabled mode, the indicator is operable to indicate that the electric propulsion device is in the drivable state. Therefore, not only the electric propulsion device driving state but also the electric propulsion device drivable state are communicated to the surroundings. Further, the indicator is located above the draft line of the hull, making it possible to perform the indicator control operation to the surroundings in an easily recognizable manner.

In a preferred embodiment of the present invention, the watercraft propulsion system further includes an engine propulsion device attachable to the hull. The plurality of control modes further include an electric propulsion device disabled mode in which the engine propulsion device is enabled to generate a propulsive force and the electric propulsion device is disabled from being driven. The controller is configured or programmed to perform an indicator stopping control operation in the electric propulsion device disabled mode to stop the actuation of the indicator.

With this arrangement, even if the propulsive force generation by the engine propulsion device is enabled, the indicator does not perform the indicator control operation in the control mode in which the driving of the electric propulsion device is disabled. When the propulsive force generation by the engine propulsion device is enabled, the engine of the engine propulsion device is in operation. Therefore, surrounding people can easily know, from an operation sound and vibrations generated by the operation of the engine, that the watercraft propulsion system is in a propulsive force generatable state. Thus, the indicator control operation is stopped in the electric propulsion device disabled mode to prevent the indicator from being uselessly performed. The indicator control operation is performed when needed, thus facilitating communication to and recognition by the surroundings.

In a preferred embodiment of the present invention, the watercraft propulsion system further includes a lift to move up and down the propeller of the electric propulsion device between an underwater position and an above-water position. The controller is configured or programmed to enable the indicator control operation when the propeller is in the underwater position, and to disable the indicator control operation when the propeller is in the above-water position.

With this arrangement, when the propeller of the electric propulsion device is in the above-water position, the indicator control operation is disabled and, therefore, is prevented from being uselessly performed. Thus, the indicator control operation is effectively performed when needed.

In a preferred embodiment of the present invention, the watercraft propulsion system further includes an operator operable by a user to maneuver the hull. The electric propulsion device enabled mode includes an operation response mode in which the controller is configured or programmed to drive the electric propulsion device in response to the operation of the operator.

With this arrangement, the indicator is actuated in the control mode in which the electric propulsion device is drivable in response to the operation of the operator and, therefore, the electric propulsion device drivable state is easily recognizable by the surroundings.

In a preferred embodiment of the present invention, the electric propulsion device enabled mode includes an operation hold mode in which an operation state value indicating the operation state of the operator is stored and the controller is configured or programmed to drive the electric propulsion device according to the stored operation state value.

With this arrangement, the indicator is actuated not only when the operator is operated but also in the operation hold mode in which the electric propulsion device is driven according to the stored operation state value. Thus, recognition by the surroundings is facilitated.

In a preferred embodiment of the present invention, the electric propulsion device enabled mode further includes an automatic mode in which the behavior of the hull is controlled without operating the operator.

With this arrangement, when the electric propulsion device is drivable according to the automatic mode, the indicator is actuated. Thus, recognition by the surroundings is facilitated.

In a preferred embodiment of the present invention, the indicator is provided on the hull.

The indicator may be provided on a portion of the electric propulsion device above the draft line of the hull.

Another preferred embodiment of the present invention provides a watercraft propulsion system including an electric propulsion device attachable to a hull, and an indicator located above the draft line of the hull and operable to indicate to surroundings of the electric propulsion device that the electric propulsion device is in a drivable state.

With this arrangement, when the electric propulsion device is in the drivable state, the indicator control operation by the indicator facilitates communication to and recognition by the surroundings.

In a preferred embodiment of the present invention, the watercraft propulsion system further includes an engine propulsion device attachable to the hull.

In a preferred embodiment of the present invention, the electric propulsion device and the engine propulsion device are provided side by side on the stern of the hull. The indicator generates an indicator signal that is recognizable from a rear side of the hull.

With this arrangement, the indicator signal is recognizable from the rear side of the hull (i.e., from the direction of the stern on which the electric propulsion device and the engine propulsion device are attached side by side). Therefore, the indicator information that the electric propulsion device is in the drivable state is properly provided to the surroundings of the electric propulsion device (particularly, to the user of another watercraft sailing there behind).

The indicator signal may be an optical signal or a sound signal, or may include both the optical signal and the sound signal.

Another further preferred embodiment of the present invention provides a watercraft including a hull, and a watercraft propulsion system provided on the hull and including any of the above-described features.

The above and other elements, features, steps, characteristics and advantages of the present invention will become more apparent from the following detailed description of the preferred embodiments with reference to the attached drawings.

BRIEF DESCRIPTION OF THE DRAWINGS

FIG. 11 shows an exemplary control table to be used to control lamps on the hull.

DETAILED DESCRIPTION OF THE PREFERRED EMBODIMENTS

Figure 1:
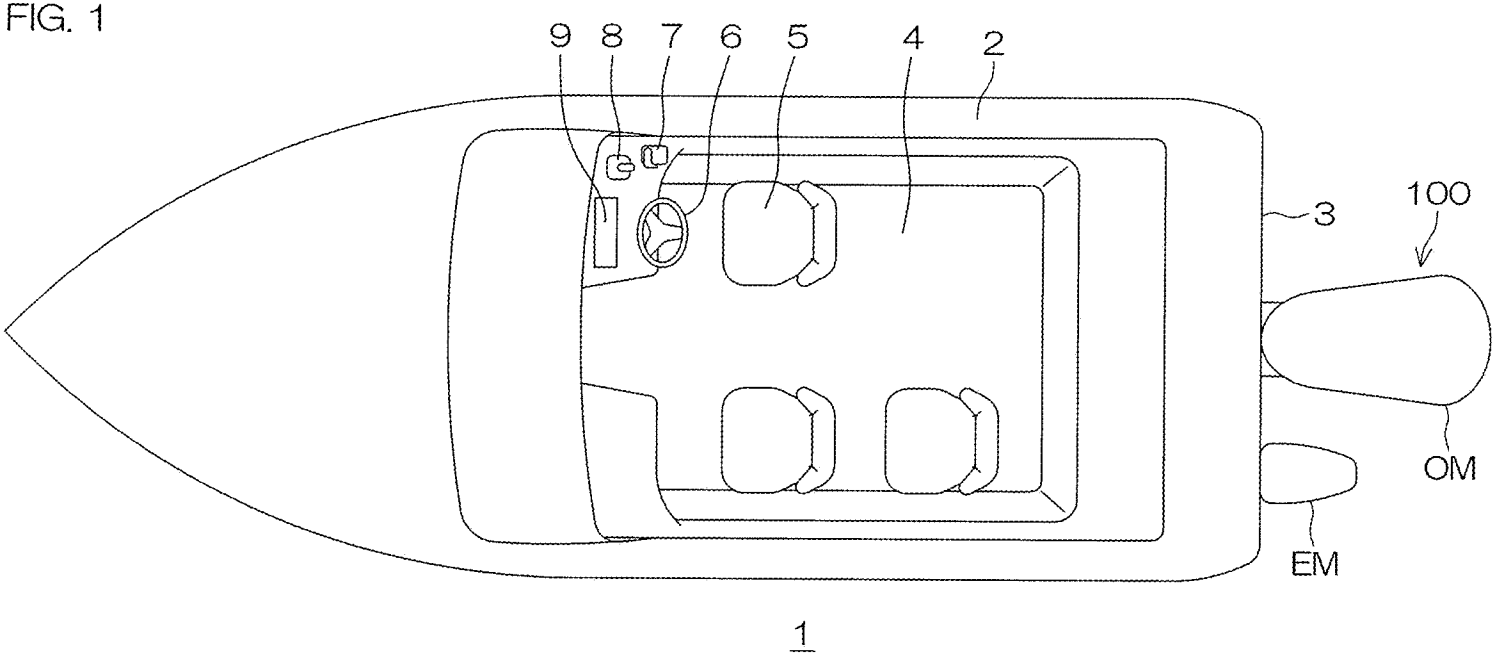
FIG. 1 is a plan view showing an exemplary construction of a watercraft mounted with a watercraft propulsion system according to a preferred embodiment of the present invention.
Figure 2:
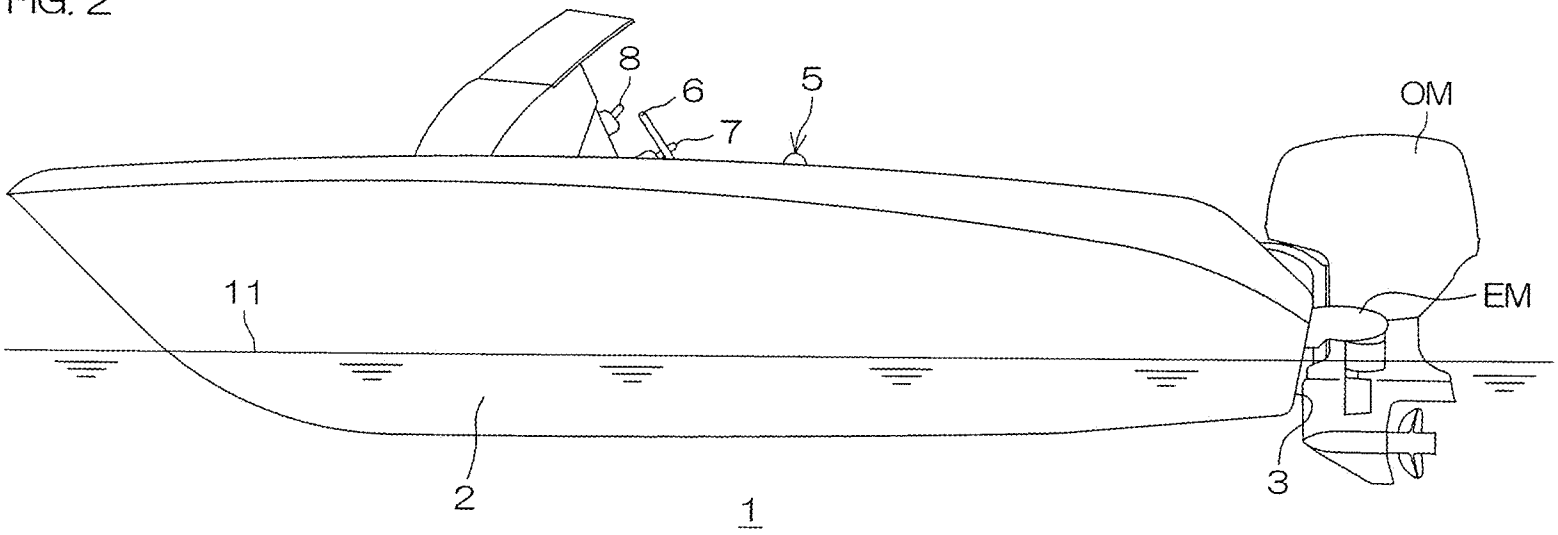
FIG. 2 is a side view of the watercraft as seen from a left side with respect to the bow direction of the watercraft.

FIG. 1 is a plan view showing an exemplary construction of a watercraft 1 mounted with a watercraft propulsion system 100 according to a preferred embodiment of the present invention. FIG. 2 is a side view of the watercraft 1 as seen from a left side with respect to the bow direction of the watercraft 1.

The watercraft 1 includes a hull 2, an engine outboard motor OM attached to the hull 2, and an electric outboard motor EM attached to the hull 2. The engine outboard motor OM and the electric outboard motor EM are exemplary propulsion devices. The engine outboard motor OM is an exemplary main propulsion device. The electric outboard motor EM is an exemplary auxiliary propulsion device having a lower rated output than the main propulsion device. The engine outboard motor OM is an example of the engine propulsion device including an engine as its power source. The electric outboard motor EM is an example of the electric propulsion device including an electric motor as its power source.

In the present preferred embodiment, the engine outboard motor OM and the electric outboard motor EM are attached to the stern 3 of the watercraft 1. More specifically, the engine outboard motor OM and the electric outboard motor EM are disposed side by side transversely of the hull 2 on the stern 3. In this example, the engine outboard motor OM is disposed on a transversely middle portion of the stern 3, and the electric outboard motor EM is disposed outward (leftward) of the transversely middle portion of the stern 3.

A usable space 4 for passengers is provided inside the hull 2. A helm seat 5 is provided in the usable space 4. A steering wheel 6, a remote control lever 7, a joystick 8, a gauge 9 (display panel) and the like are provided in association with the helm seat 5. The steering wheel 6 is an operator operable by a user to change the course of the watercraft 1. The remote control lever 7 is an operator operable by the user to change the magnitude (output) and the direction (forward or reverse direction) of the propulsive force of the engine outboard motor OM, and corresponds to an acceleration operator. The joystick 8 is an operator to be operated instead of the steering wheel 6 and the remote control lever 7 by the user to maneuver the watercraft.

Figure 3:
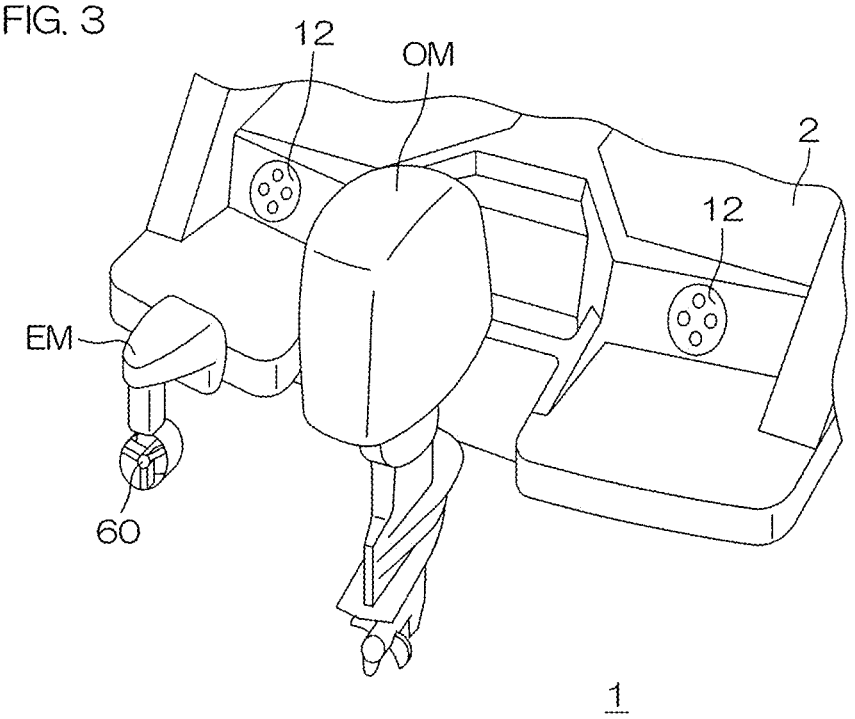
FIG. 3 is a perspective view showing the structure of a rear portion of a hull as seen in a downward direction from the upper rear side of the watercraft.

FIG. 3 is a perspective view showing the structure of a rear portion of the hull 2 as seen downward from the upper rear side of the watercraft 1. On the hull 2, lamps 12 are provided as an example of the indicator and are located above a draft line 11 (see FIG. 2) of the hull 2, i.e., above water surface. In the present preferred embodiment, the lamps 12 are LED (light emitting diode) lamps. In the present preferred embodiment, left and right lamps 12 are provided in a pair on opposite sides of the engine outboard motor OM disposed in the middle as seen from the rear side.

The lamps 12 are mounted on the hull 2 so as to emit light toward the surroundings of the electric outboard motor EM. More specifically, the lamps 12 are directed rearward of the hull 2 so that an optical signal indicating the state of the electric outboard motor EM is emitted especially to the rear side of the hull 2, i.e., to the surroundings of the electric outboard motor EM (particularly, to the user of another watercraft sailing behind). The optical signal is an example of the indicator signal recognizable from the rear side of the hull 2.

The lamps 12 emit light when the electric outboard motor EM is in a drivable state. The drivable state herein includes not only a state such that the electric outboard motor EM is driven to rotate its propeller 60 but also a standby state such that the electric outboard motor EM is drivable with the power supply thereto turned on.

Figure 4:
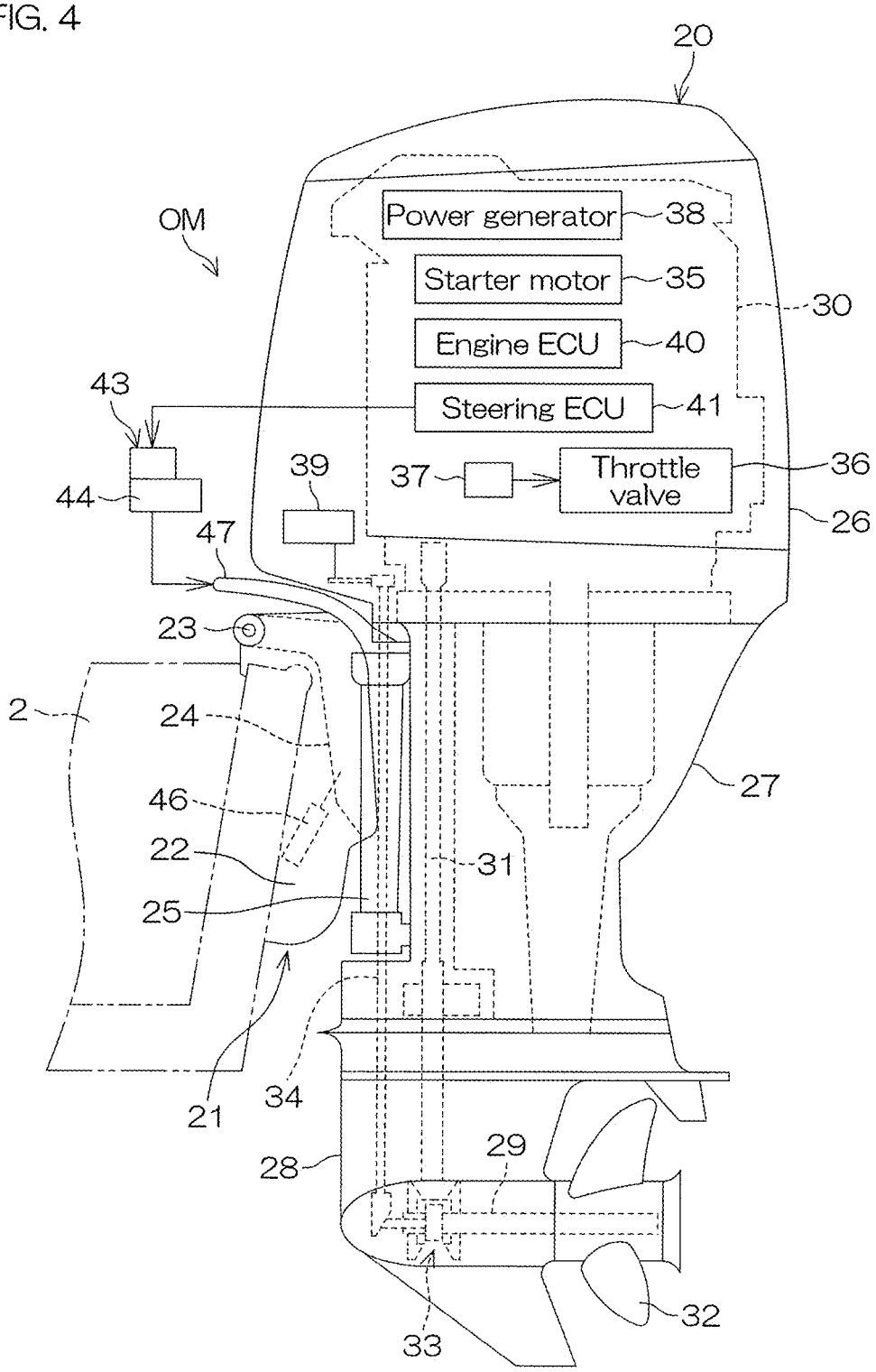
FIG. 4 is a side view showing the structure of an engine outboard motor by way of example.

FIG. 4 is a side view showing the structure of the engine outboard motor OM by way of example. The engine outboard motor OM includes a propulsion unit 20, and an attachment mechanism 21 that attaches the propulsion unit 20 to the hull 2. The attachment mechanism 21 includes a clamp bracket 22 detachably fixed to a transom plate provided on the stern 3 of the hull 2, and a swivel bracket 24 connected to the clamp bracket 22 pivotally about a tilt shaft 23 (horizontal pivot shaft). The propulsion unit 20 is attached to the swivel bracket 24 pivotally about a steering shaft 25. Thus, a steering angle (the azimuth angle of a propulsive force direction with respect to the center line of the hull 2) is changeable by pivoting the propulsion unit 20 about the steering shaft 25. Further, the trim angle of the propulsion unit 20 is changeable by pivoting the swivel bracket 24 about the tilt shaft 23. The trim angle is an angle at which the engine outboard motor OM is attached to the hull 2.

The housing of the propulsion unit 20 includes an engine cover (top cowling) 26, an upper case 27 and a lower case 28. An engine 30 is provided as a prime mover in the engine cover 26 with the axis of its crank shaft extending vertically. A drive shaft 31 for power transmission is connected to the lower end of the crank shaft of the engine 30, and extends vertically through the upper case 27 into the lower case 28.

A propeller 32 is provided as a propulsion member rotatably at the lower rear side of the lower case 28. A propeller shaft 29, which is the rotation shaft of the propeller 32, extends horizontally through the lower case 28. The rotation of the drive shaft 31 is transmitted to the propeller shaft 29 via a shift mechanism 33.

The shift mechanism 33 has a plurality of shift positions (shift states) including a forward shift position, a reverse shift position, and a neutral shift position. The neutral shift position corresponds to a cutoff state in which the rotation of the drive shaft 31 is not transmitted to the propeller shaft 29. The forward shift position corresponds to a state such that the rotation of the drive shaft 31 is transmitted to the propeller shaft 29 so as to rotate the propeller shaft 29 in a forward drive rotation direction. The reverse shift position corresponds to a state such that the rotation of the drive shaft 31 is transmitted to the propeller shaft 29 so as to rotate the propeller shaft 29 in a reverse drive rotation direction. The forward drive rotation direction is such that the propeller 32 is rotated so as to apply a forward propulsive force to the hull 2. The reverse drive rotation direction is such that the propeller 32 is rotated so as to apply a reverse propulsive force to the hull 2. The shift position of the shift mechanism 33 is switched by a shift rod 34. The shift rod 34 extends vertically parallel to the drive shaft 31, and is configured so as to be pivoted about its axis to operate the shift mechanism 33.

A starter motor 35 to start the engine 30, and a power generator 38 to generate electric power by the power of the engine 30 after the startup of the engine 30 are provided in association with the engine 30. The starter motor 35 is controlled by an engine ECU (Electronic Control Unit) 40. The electric power generated by the power generator 38 is supplied to electric components provided in the engine outboard motor OM and, in addition, is used to charge batteries 130, 145 (see FIG. 7) accommodated in the hull 2 (see FIGS. 1 and 2). Further, a throttle actuator 37 is provided in association with the engine 30. The throttle actuator 37 actuates the throttle valve 36 of the engine 30 so as to change the throttle opening degree of the engine 30 to change the intake air amount of the engine 30. The throttle actuator 37 may be an electric motor. The operation of the throttle actuator 37 is controlled by the engine ECU 40.

A shift actuator 39 that changes the shift position of the shift mechanism 33 is provided in association with the shift rod 34. The shift actuator 39 is, for example, an electric motor, and the operation of the shift actuator 39 is controlled by the engine ECU 40.

Further, a steering rod 47 is fixed to the propulsion unit 20, and a steering device 43 to be driven according to the operation of the steering wheel 6 (see FIG. 1) is connected to the steering rod 47. The steering device 43 pivots the propulsion unit 20 about the steering shaft 25 to perform a steering operation. The steering device 43 includes a steering actuator 44. The steering actuator 44 is controlled by a steering ECU 41. The steering ECU 41 may be provided in the propulsion unit 20. The steering actuator 44 may be an electric motor, or may be a hydraulic actuator.

A tilt/trim actuator 46 is provided between the clamp bracket 22 and the swivel bracket 24. The tilt/trim actuator 46 includes, for example, a hydraulic cylinder, and is controlled by the engine ECU 40. The tilt/trim actuator 46 pivots the swivel bracket 24 about the tilt shaft 23 to pivot the propulsion unit 20 about the tilt shaft 23.

Figure 5:
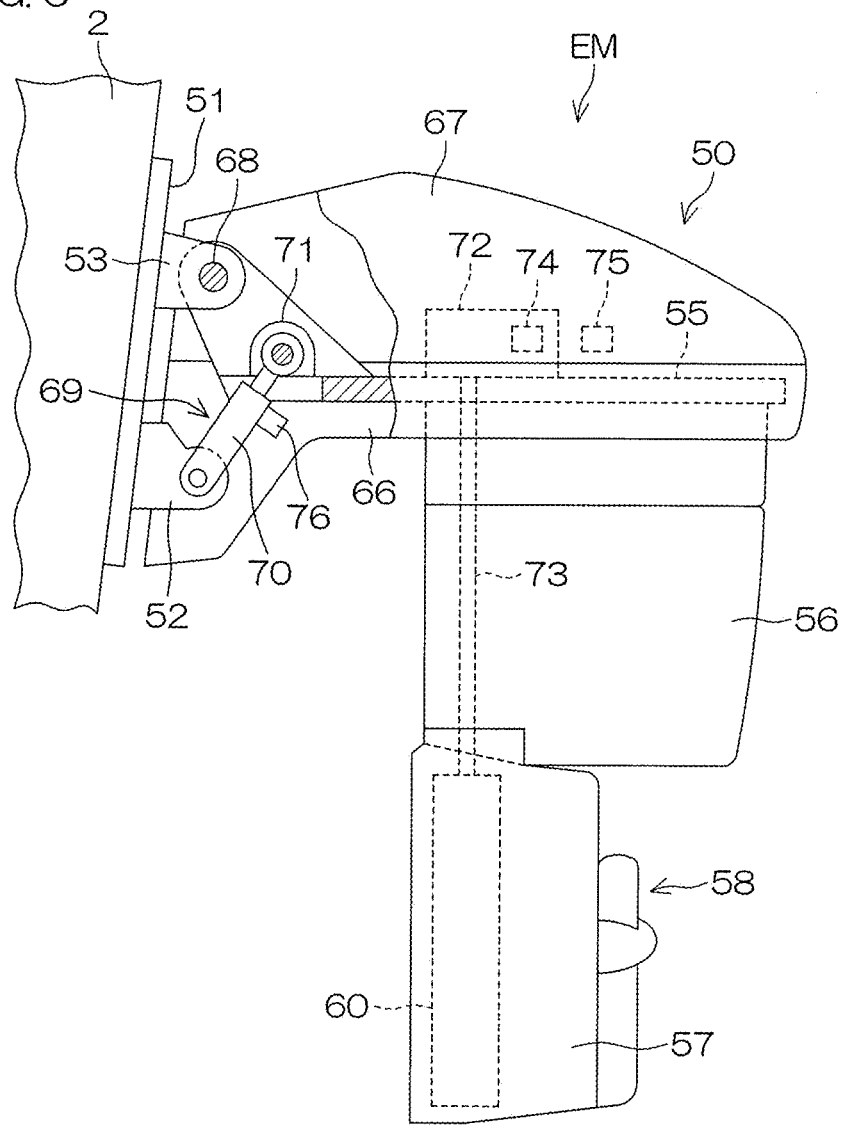
FIG. 5 is a side view showing the structure of an electric outboard motor by way of example.
Figure 6:
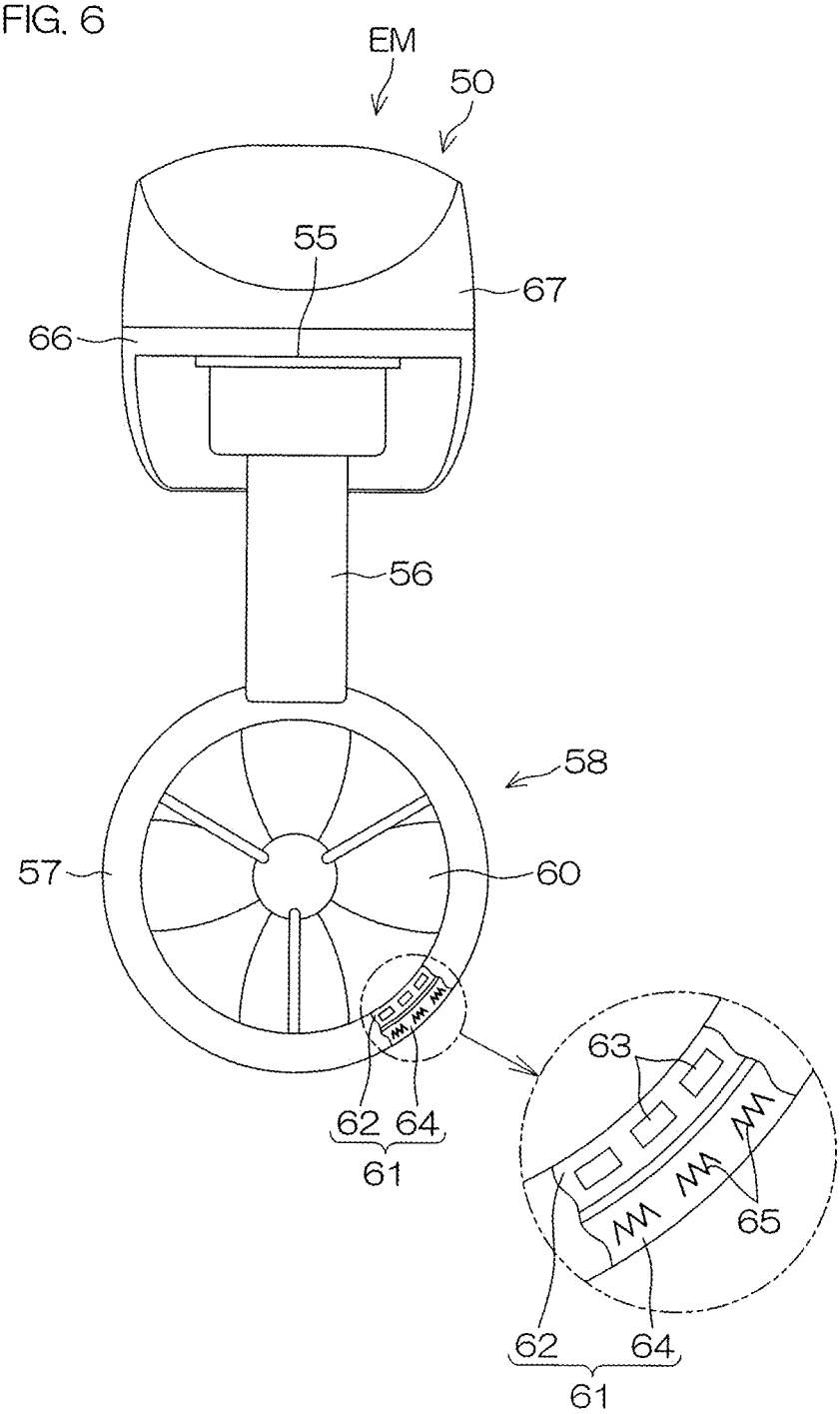
FIG. 6 is a rear view of the electric outboard motor as seen from the rear side of the watercraft.

FIG. 5 is a side view showing the structure of the electric outboard motor EM by way of example, and FIG. 6 is a rear view of the electric outboard motor EM as seen from the rear side of the watercraft 1.

The electric outboard motor EM includes a bracket 51 for attachment thereof to the hull 2, and a propulsion device body 50. The propulsion device body 50 is supported by the bracket 51. The propulsion device body 50 includes a base 55 supported by the bracket 51, an upper housing 56 extending downward from the base 55, a tubular (duct-shaped) lower housing 57 disposed below the upper housing 56, and a drive unit 58 disposed in the lower housing 57. The propulsion device body 50 further includes a cover 66 that covers the base 55 from the lower side, and a cowl 67 that covers the base 55 from the upper side. A tilt unit 69 and a steering unit 72 are accommodated in a space defined by the cover 66 and the cowl 67. Further, a buzzer 75 that generates sound when the tilt unit 69 is actuated may be accommodated in this space.

The drive unit 58 includes a propeller 60, and an electric motor 61 that rotates the propeller 60. The electric motor 61 includes a tubular rotor 62 to which the propeller 60 is fixed radially inward thereof, and a tubular stator 64 that surrounds the rotor 62 from the radially outside. The stator 64 is fixed to the lower housing 57, and the rotor 62 is supported rotatably with respect to the lower housing 57. The rotor 62 includes a plurality of permanent magnets 63 disposed circumferentially thereof. The stator 64 includes a plurality of coils 65 disposed circumferentially thereof. The rotor 62 is rotated by energizing the coils 65 such that the propeller 60 is correspondingly rotated to generate a propulsive force.

The tilt unit 69 includes a tilt cylinder 70 as a tilt actuator. The tilt cylinder 70 may be a hydraulic cylinder of electric pump type adapted to pump a hydraulic oil by an electric pump. One of opposite ends of the tilt cylinder 70 is connected to the lower support portion 52 of the bracket 51, and the other end of the tilt cylinder 70 is connected to the base 55 via a cylinder connection bracket 71. A tilt shaft 68 is supported by the upper support portion 53 of the bracket 51, and the base 55 is connected to the bracket 51 via the tilt shaft 68 pivotally about the tilt shaft 68. The tilt shaft 68 extends transversely of the hull 2, so that the base 55 is pivotable upward and downward. Thus, the propulsion device body 50 is pivotable upward and downward about the tilt shaft 68.

An expression "tilt-up" means that the propulsion device body 50 is pivoted upward about the tilt shaft 68, and an expression "tilt-down" means that the propulsion device body 50 is pivoted downward about the tilt shaft 68. The tilt cylinder 70 is driven to be extended and retracted such that the tilt-up and the tilt-down are achieved. The propeller 60 is moved up to an above-water position by the tilt-up such that the propulsion device body 50 is brought into a tilt-up state. Further, the propeller 60 is moved down to an underwater position by the tilt-down such that the propulsion device body 50 is brought into a tilt-down state. Thus, the tilt unit 69 is an example of the lift or lift device that moves up and down the propeller 60.

A tilt angle sensor 76 is provided to detect a tilt angle (i.e., the angle of the propulsion device body 50 with respect to the bracket 51) to detect the tilt-up state and the tilt-down state of the propulsion device body 50. The tilt angle sensor 76 may be a position sensor that detects the position of the actuation rod of the tilt cylinder 70.

The steering unit 72 includes a steering shaft 73 connected to the lower housing 57 and the upper housing 56, and a steering motor 74. The steering motor 74 is an example of a steering actuator that generates a drive force to pivot the steering shaft 73 about its axis. The steering unit 72 may further include a reduction gear that reduces the rotation speed of the steering motor 74 and transmits the rotation of the steering motor 74 to the steering shaft 73. Thus, the lower housing 57 and the upper housing 56 are pivoted about the steering shaft 73 by driving the steering motor 74 such that the direction of the propulsive force generated by the drive unit 58 is changeable leftward and rightward. The upper housing 56 has a plate shape that extents anteroposteriorly of the hull 2 in a neutral steering position, and functions as a rudder plate to be steered by the steering unit 72.

Figure 7:
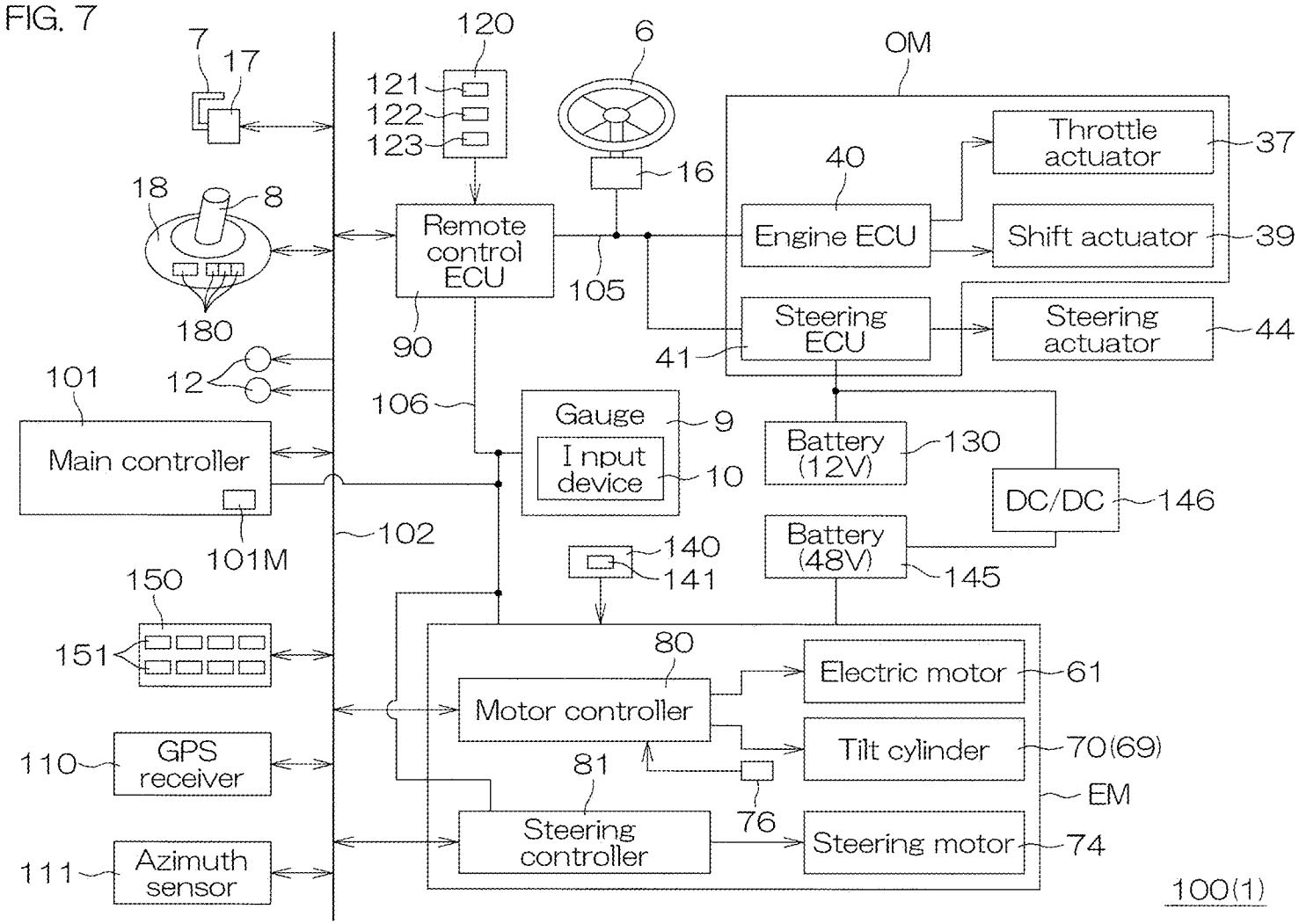
FIG. 7 is a block diagram showing the configuration of the watercraft propulsion system by way of example.

FIG. 7 is a block diagram showing an exemplary configuration of the watercraft propulsion system 100 provided in the watercraft 1. The watercraft propulsion system 100 includes the engine outboard motor OM as the main propulsion device, and the electric outboard motor EM as the auxiliary propulsion device. The watercraft propulsion system 100 includes the lift device to move up and down the propeller 60 of the electric outboard motor EM (see FIGS. 5 and 6) between the underwater position and the above-water position. In the present preferred embodiment, the tilt unit 69 provided in the electric outboard motor EM is an example of the lift device. The lift device such as the tilt unit 69 may be incorporated in the electric outboard motor EM, or may be provided separately from the electric outboard motor EM.

The watercraft propulsion system 100 includes a main controller 101. The main controller 101 is connected to an onboard network 102 (CAN: Control Area Network) provided in the hull 2. A remote control unit 17, a remote control ECU 90, a joystick unit 18, a GPS (Global Positioning System) receiver 110, an azimuth sensor 111, and the like are connected to the onboard network 102. The engine ECU 40 and the steering ECU 41 are connected to the remote control ECU 90 via an outboard motor control network 105. The main controller 101 transmits and receives signals to/from various units connected to the onboard network 102 to control the engine outboard motor OM and the electric outboard motor EM, and further controls other units. The main controller 101 has a plurality of control modes, and controls the units in predetermined manners according to the respective control modes.

A steering wheel unit 16 is connected to the outboard motor control network 105. The steering wheel unit 16 outputs an operation angle signal indicating the operation angle of the steering wheel 6 to the outboard motor control network 105. The operation angle signal is received by the remote control ECU 90 and the steering ECU 41. In response to the operation angle signal generated by the steering wheel unit 16 or a steering angle command applied from the remote control ECU 90, the steering ECU 41 correspondingly controls the steering actuator 44 to control the steering angle of the engine outboard motor OM.

The remote control unit 17 generates an operation position signal indicating the operation position of the remote control lever 7.

The joystick unit 18 generates an operation position signal indicating the operation position of the joystick 8, and generates an operation signal when one of operation buttons 180 of the joystick unit 18 is operated.

The remote control ECU 90 outputs a propulsive force command to the engine ECU 40 via the outboard motor control network 105. The propulsive force command includes a shift command that indicates the shift position of the shift mechanism 33, and an output command that indicates the output (specifically, the rotation speed) of the engine 30. Further, the remote control ECU 90 outputs the steering angle command to the steering ECU 41 via the outboard motor control network 105.

The remote control ECU 90 performs different control operations according to different control modes of the main controller 101. In a control mode to maneuver the watercraft with the use of the steering wheel 6 and the remote control lever 7, for example, the propulsive force command (the shift command and the output command) is generated according to the operation position signal generated by the remote control unit 17, and is applied to the engine ECU 40 by the remote control ECU 90. Further, the remote control ECU 90 commands the steering ECU 41 to conform to the operation angle signal generated by the steering wheel unit 16. In a control mode for maneuvering the watercraft without the use of the steering wheel 6 and the remote control lever 7, on the other hand, the remote control ECU 90 conforms to commands applied by the main controller 101. That is, the main controller 101 generates the propulsive force command (the shift command and the output command) and the steering angle command, which are outputted to the engine ECU 40 and the steering ECU 41, respectively, by the remote control ECU 90. In a control mode for maneuvering the watercraft with the use of the joystick 8, for example, the main controller 101 generates the propulsive force command (the shift command and the output command) and the steering angle command according to the signals generated by the joystick unit 18. The magnitude and the direction (the forward direction or the reverse direction) of the propulsive force of the engine outboard motor OM and the steering angle of the engine outboard motor OM are controlled according to the propulsive force command (the shift command and the output command) and the steering angle command thus generated.

The engine ECU 40 drives the shift actuator 39 according to the shift command to control the shift position, and drives the throttle actuator 37 according to the output command to control the throttle opening degree. The steering ECU 41 controls the steering actuator 44 according to the steering angle command to control the steering angle of the engine outboard motor OM.

The electric outboard motor EM includes a motor controller 80 and a steering controller 81 connected to the onboard network 102, and is configured to be actuated in response to commands applied from the main controller 101. The main controller 101 applies a propulsive force command and a steering angle command to the electric outboard motor EM. The propulsive force command includes a shift command and an output command. The shift command is a rotation direction command that indicates the stop of the propeller 60, the forward drive rotation of the propeller 60, or the reverse drive rotation of the propeller 60. The output command indicates a propulsive force to be generated, specifically the target value of the rotation speed of the propeller 60. The steering angle command indicates the target value of the steering angle of the electric outboard motor EM. The motor controller 80 controls the electric motor 61 according to the shift command (rotation direction command) and the output command. The steering controller 81 controls the steering motor 74 according to the steering angle command.

Further, the main controller 101 applies a tilt command to the motor controller 80 via the onboard network 102. The tilt command indicates the target value of the tilt angle of the electric outboard motor EM. The motor controller 80 actuates the tilt cylinder 70 according to the tilt command to tilt up or down the electric outboard motor EM to the target tilt angle. The detection signal of the tilt angle sensor 76 is inputted to the motor controller 80. Thus, the motor controller 80 can acquire the information of the tilt angle of the propulsion device body 50, and transmit the tilt angle information to the main controller 101.

The GPS receiver 110 detects the position of the watercraft 1 by receiving radio waves from an artificial satellite orbiting the earth, and outputs position data indicating the position of the watercraft 1 and speed data indicating the moving speed of the watercraft 1. The main controller 101 acquires the position data and the speed data, which are used to control and display the position and/or the azimuth of the watercraft 1.

The azimuth sensor 111 detects the azimuth of the watercraft 1, and generates azimuth data, which is used by the main controller 101.

The gauge 9 is connected to the main controller 101 via a control panel network 106. The gauge 9 is a display device that displays various information to maneuver the watercraft. The gauge 9 is connected to the remote control ECU 90, the motor controller 80 and the steering controller 81 via the control panel network 106. Thus, the gauge 9 can display information such as of the operation state of the engine outboard motor OM, the operation state of the electric outboard motor EM, and the position and/or the azimuth of the watercraft 1. The gauge 9 may include an input device 10 such as a touch panel and buttons. The input device 10 may be operated by the user to set various settings and give various commands such that operation signals are outputted to the control panel network 106.

A power switch unit 120 operable to turn on a power supply to the engine outboard motor OM and to start and stop the engine 30 is connected to the remote control ECU 90. The power switch unit 120 includes a power switch 121 operable to turn on and off the power supply to the engine outboard motor OM, a start switch 122 operable to start the engine 30, and a stop switch 123 operable to stop the engine 30.

With the power switch 121 turned on, the remote control ECU 90 performs a power supply control to control the power supply to the engine outboard motor OM. Specifically, a power supply relay (not shown) provided between the battery 130 (e.g., 12 V) and the engine outboard motor OM is turned on. When the start switch 122 is operated with the power supply to the engine outboard motor OM turned on, the remote control ECU 90 applies a start command to the engine ECU 40. Thus, the engine ECU 40 actuates the starter motor 35 (see FIG. 4) to start the engine 30. During the operation of the engine 30, the battery 130 is charged with the electric power generated by the power generator 38 (see FIG. 4). When the stop switch 123 is operated during the operation of the engine, the remote control ECU 90 applies an engine stop command to the engine ECU 40. In response to the engine stop command, the engine ECU 40 performs a stop control operation to stop the engine 30. Engine outboard motor state information indicating whether or not the power supply to the engine outboard motor OM is turned on and whether or not the engine 30 is in operation is applied to the main controller 101 via the onboard network 102 by the remote control ECU 90.

A power switch unit 140 operable to turn on and off a power supply to the electric outboard motor EM is connected to the electric outboard motor EM. By turning on and off a power switch 141 provided in the power switch unit 140, a circuit connected between the electric outboard motor EM and the battery 145 (e.g., 48 V) that supplies the electric power to the electric outboard motor EM is closed and opened to turn on and off the power supply to the electric outboard motor EM. Electric outboard motor state information indicating whether or not the electric outboard motor EM is turned on, i.e., whether or not the electric outboard motor EM is in the drivable state, is applied to the main controller 101 via the onboard network 102 by the motor controller 80. The battery 145 is able to receive the electric power generated by the power generator 38 (see FIG. 4) of the engine outboard motor OM via a DC/DC convertor 146 (voltage transformer).

Further, an application switch panel 150 is connected to the onboard network 102. The application switch panel 150 includes a plurality of function switches 151 operable to apply predefined function commands. For example, the function switches 151 may include switches for automatic watercraft maneuvering commands. Specific examples of the function switches 151 may include switches for an automatic steering function of maintaining the azimuth of the watercraft 1, for an automatic steering function of maintaining the course of the watercraft 1, for an automatic steering function of causing the watercraft 1 to pass through a plurality of checkpoints sequentially, and for an automatic steering function of causing the watercraft 1 to sail along a predetermined pattern (zig-zag pattern, spiral pattern or the like). A function for the tilt-up or the tilt-down of the electric outboard motor EM may be assigned to one of the function switches 151.

The main controller 101 is able to control the engine outboard motor OM and the electric outboard motor EM in a plurality of control modes. The control modes include a plurality of modes each defined by the state of the engine outboard motor OM and the state of the electric outboard motor EM. Specific examples of the control modes include an electric mode, an engine mode, a dual mode and an extender mode. The main controller 101 operates according to any one of the control modes based on the engine outboard motor state information and the electric outboard motor state information.

In the electric mode, the power supply to the electric outboard motor EM is turned on, and the power supply to the engine outboard motor OM is turned off. That is, only the electric outboard motor EM generates the propulsive force in the electric mode. In the engine mode, the engine 30 is in operation with the power supply to the engine outboard motor OM turned on, and the power supply to the electric outboard motor EM is turned off. That is, only the engine outboard motor OM generates the propulsive force in the engine mode. In the dual mode and the extender mode, the power supply to the electric outboard motor EM is turned on, and the engine 30 of the engine outboard motor OM is in operation. In the dual mode, the propulsive force generated by the engine outboard motor OM and the propulsive force generated by the electric outboard motor EM are both utilized. In the extender mode, only the propulsive force generated by the electric outboard motor EM is utilized, and the engine 30 is driven to generate the electric power to charge the battery 145. In the electric mode and the extender mode, the electric outboard motor EM generates the propulsive force likewise. The user may set a setting or give a command to select the dual mode or the extender mode. For example, the user may operate the input device 10 provided in the gauge 9 to set the setting or give the command.

The lamps 12 are connected to the onboard network 102. The lamps 12 emit light according to a command applied from the main controller 101. That is, the main controller 101 performs an indicator control operation to light the lamps 12 to indicate that the electric outboard motor EM is in the drivable state. The lamps 12 may be continuously lit or may be intermittently lit.

Figure 8:
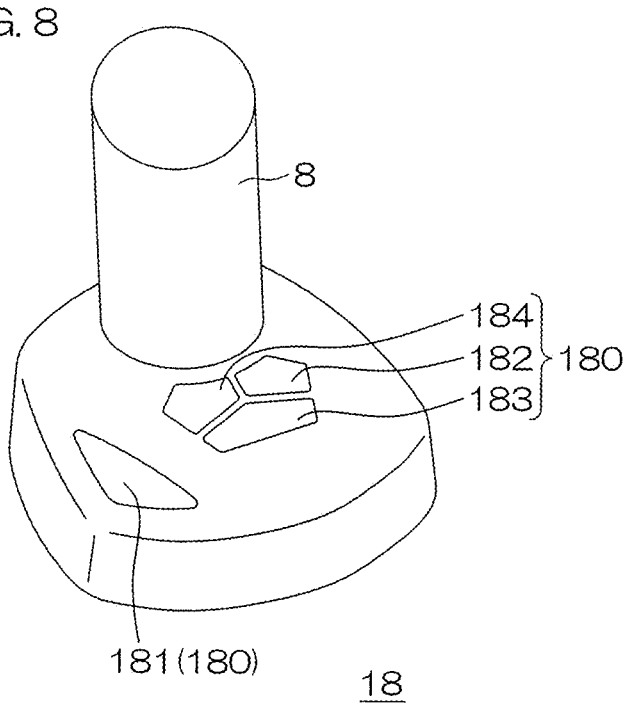
FIG. 8 is a perspective view showing the structure of a joystick unit by way of example.

FIG. 8 is a perspective view showing the structure of the joystick unit 18 by way of example. The joystick unit 18 includes the joystick 8, which is inclinable forward, backward, leftward, and rightward (i.e., in all 360-degree directions) and is pivotable (twistable) about its axis. In this example, the joystick unit 18 further includes a plurality of operation buttons 180. The operation buttons 180 include a joystick button 181 and holding mode setting buttons 182 to 184.

The joystick button 181 is an operator operable by the user to select a control mode (watercraft maneuvering mode) utilizing the joystick 8, i.e., a joystick mode.

The holding mode setting buttons 182, 183, 184 are operation buttons operable by the user to select position/azimuth holding system control modes (examples of a holding mode). More specifically, the holding mode setting button 182 is operated to select a fixed point holding mode (Stay Point™) in which the position and the bow azimuth (or the stern azimuth) of the watercraft 1 are maintained. The holding mode setting button 183 is operated to select a position holding mode (Fish Point™) in which the position of the watercraft 1 is maintained but the bow azimuth (or the stern azimuth) of the watercraft 1 is not maintained. The holding mode setting button 184 is operated to select an azimuth holding mode (Drift Point™) in which the bow azimuth (or the stern azimuth) of the watercraft 1 is maintained but the position of the watercraft 1 is not maintained.

The control mode of the main controller 101 can be classified into an ordinary mode, the joystick mode, or the holding mode in terms of operation system.

In the ordinary mode, a steering control operation is performed according to the operation angle signal generated by the steering wheel unit 16, and a propulsive force control operation is performed according to the operation signal (operation position signal) of the remote control lever 7. In the present preferred embodiment, the ordinary mode is a default control mode of the main controller 101. In the steering control operation, specifically, the steering ECU 41 drives the steering actuator 44 according to the operation angle signal generated by the steering wheel unit 16 or the steering angle command applied from the remote control ECU 90. Thus, the body of the engine outboard motor OM is steered leftward and rightward such that the propulsive force direction is changed leftward and rightward with respect to the hull 2. In the propulsive force control operation, specifically, the engine ECU 40 drives the shift actuator 39 and the throttle actuator 37 according to the propulsive force command (the shift command and the output command) applied to the engine ECU 40 by the remote control ECU 90. Thus, the shift position of the engine outboard motor OM is set to the forward shift position, the reverse shift position, or the neutral shift position, and the engine output (specifically, the engine rotation speed) is changed.

In the joystick mode, the steering control operation and the propulsive force control operation are performed according to the operation signal of the joystick 8 of the joystick unit 18.

In the joystick mode, the steering control operation and the propulsive force control operation are performed on the engine outboard motor OM if the engine outboard motor OM is in a propulsive force generatable state. That is, the main controller 101 applies the steering angle command and the propulsive force command to the remote control ECU 90, and the remote control ECU 90 applies the steering angle command and the propulsive force command to the steering ECU 41 and the engine ECU 40, respectively.

In the joystick mode, the steering control operation and the propulsive force control operation are performed on the electric outboard motor EM if the electric outboard motor EM is in a propulsive force generatable state. In the steering control operation on the electric outboard motor EM, specifically, the steering controller 81 drives the steering unit 72 according to the steering angle command applied to the steering controller 81 of the electric outboard motor EM by the main controller 101. Thus, the drive unit 58 and the upper housing 56 of the electric outboard motor EM are pivoted leftward and rightward such that the propulsive force direction is changed leftward and rightward with respect to the hull 2. In the propulsive force control operation on the electric outboard motor EM, specifically, the motor controller 80 controls the rotation direction and the rotation speed of the electric motor 61 according to the propulsive force command (the shift command and the output command) applied to the motor controller 80 of the electric outboard motor EM by the main controller 101. Thus, the rotation direction of the propeller 60 is set to a forward drive rotation direction or a reverse drive rotation direction, and the rotation speed of the propeller 60 is changed.

Figure 9A:
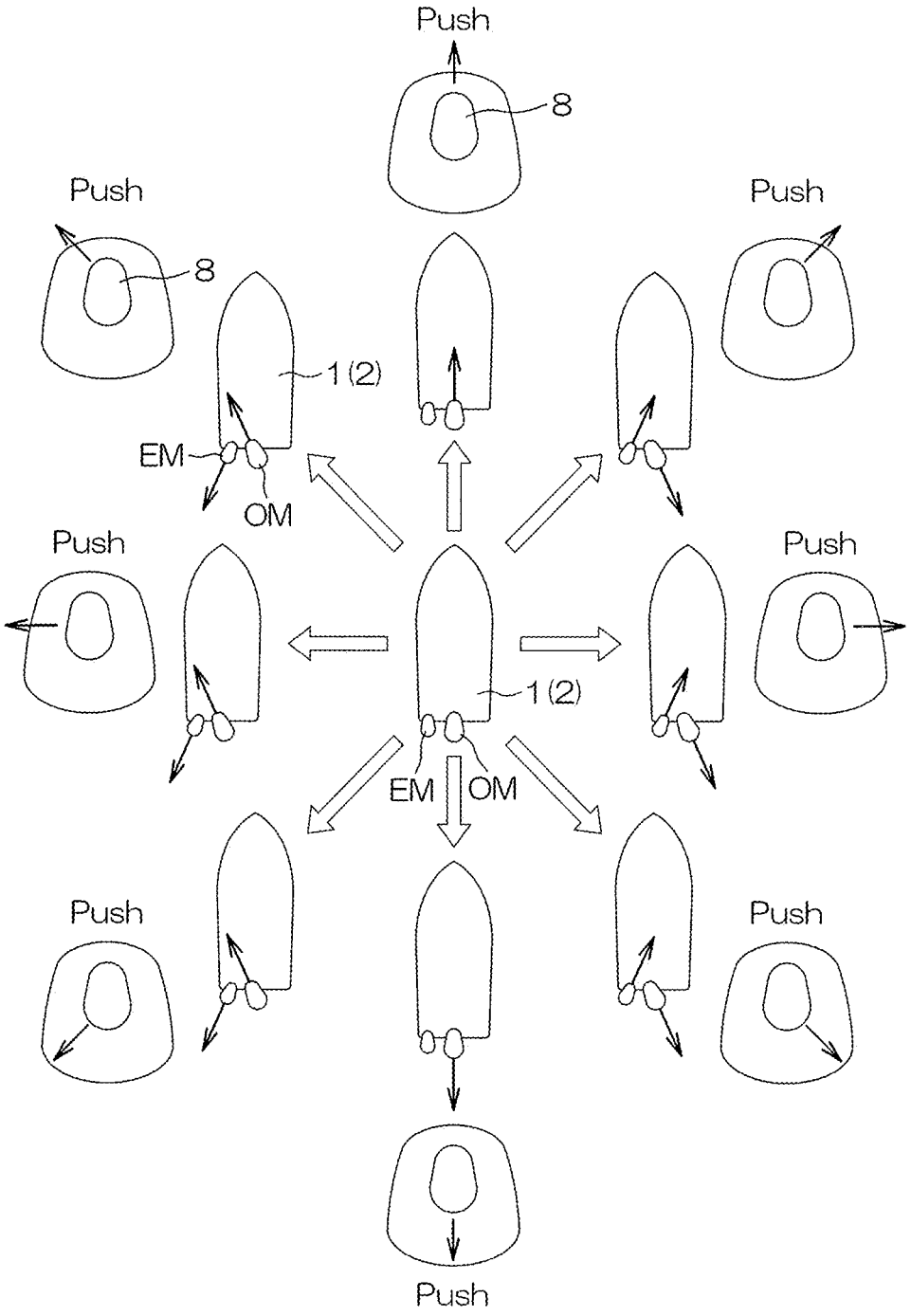
FIGS. 9A and 9B are diagrams for describing exemplary operations to be performed in a first joystick mode by utilizing the propulsive forces of two propulsion devices.
Figure 9B:
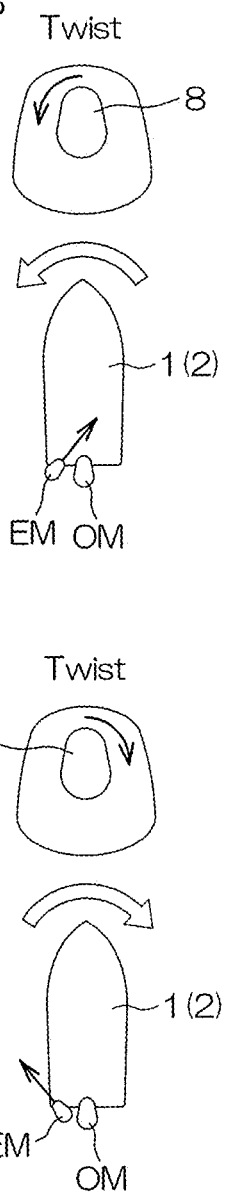
Figure 10:
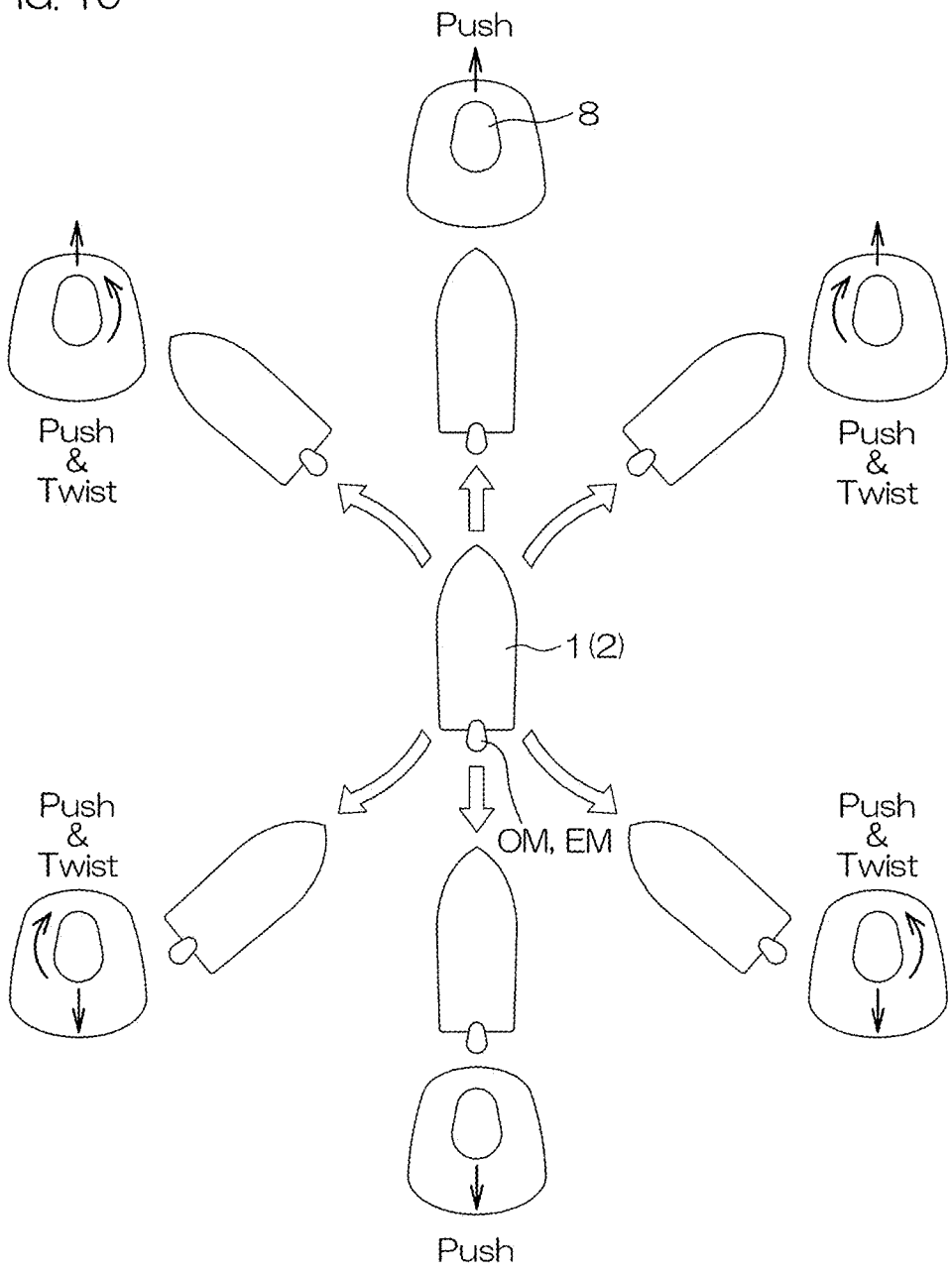
FIG. 10 is a diagram for describing an exemplary operation to be performed in a second joystick mode by utilizing the propulsive force of a single propulsion device.

FIGS. 9A, 9B, and 10 are diagrams for describing two types of joystick modes and showing the operation states of the joystick 8 and the corresponding behaviors of the hull 2. More specifically, FIGS. 9A and 9B show exemplary operations to be performed in a first joystick mode in which propulsive forces generated by the two propulsion devices (in the present preferred embodiment, the engine outboard motor OM and the electric outboard motor EM) are both utilized. FIG. 10 shows an exemplary operation to be performed in a second joystick mode in which a propulsive force generated by only one of the propulsion devices (in the present preferred embodiment, one of the engine outboard motor OM and the electric outboard motor EM) is utilized.

When the joystick mode is commanded by operating the joystick button 181 in the dual mode, the main controller 101 performs the control operation according to the first joystick mode. When the joystick mode is commanded by operating the joystick button 181 in any one of the modes other than the dual mode (the electric mode, the engine mode, or the extender mode), the main controller 101 performs the control operation in the second joystick mode.

In the first joystick mode shown in FIGS. 9A and 9B, the main controller 101 defines the inclination direction of the joystick 8 as an advancing direction command, and defines the inclination amount of the joystick 8 as a propulsive force magnitude command that indicates the magnitude of the propulsive force to be applied in the advancing direction. Further, the main controller 101 defines the pivoting direction of the joystick 8 about its axis (with respect to the neutral position of the joystick 8) as a bow turning direction command, and defines the pivoting amount of the joystick 8 (with respect to the neutral position of the joystick 8) as a bow turning speed command. For execution of these commands, the steering angle command and the propulsive force command are generated by the main controller 101 and inputted to the remote control ECU 90 and to the steering controller 81 and the motor controller 80 of the electric outboard motor EM. The remote control ECU 90 transmits the steering angle command and the propulsive force command to the steering ECU 41 and the engine ECU 40, respectively, of the engine outboard motor OM. Thus, the engine outboard motor OM is steered to a steering angle according to the steering command, and the shift position and the engine rotation speed of the engine outboard motor OM are controlled so as to generate a propulsive force according to the propulsive force command. Further, the drive unit 58 and the upper housing 56 of the electric outboard motor EM are steered to a steering angle according to the steering command, and the rotation direction and the rotation speed of the electric motor 61 of the electric outboard motor EM are controlled so as to generate a propulsive force according to the propulsive force command.

When the joystick 8 is inclined without being pivoted in the first joystick mode, the hull 2 is moved in a direction corresponding to the inclination direction of the joystick 8 without the bow turning, i.e., with its azimuth maintained. That is, the hull 2 is in a hull translation behavior. Examples of the hull translation behavior are shown in FIG. 9A. In general, the hull translation behavior is typically achieved by driving one of the two propulsion devices in a forward drive mode and driving the other propulsion device in a reverse drive mode with the propulsive force action lines of the two propulsion devices (extending along the respective propulsive force directions) crossing each other in the hull 2. Thus, the hull 2 translates in the direction of the resultant force of the propulsive forces generated by the two outboard motors OM, EM. Where the engine outboard motor OM and the electric outboard motor EM generate propulsive forces of the same magnitude with one of the outboard motors OM, EM driven in the forward drive mode and the other outboard motor driven in the reverse drive mode, for example, the hull 2 can translate laterally. In the examples shown in FIG. 9A, only the propulsive force of the engine outboard motor OM is utilized to move the hull 2 forward in the bow direction and rearward in the stern direction.

When the joystick 8 is pivoted (twisted) without being inclined in the first joystick mode, the bow of the hull 2 is turned in a direction corresponding to the pivoting direction of the joystick 8 without any substantial position change. That is, the hull 2 is in a fixed-point bow turning behavior. Examples of the fixed-point bow turning behavior are shown in FIG. 9B. In these examples, only the propulsive force of the electric outboard motor EM is utilized for the fixed-point bow turning behavior.

When the joystick 8 is inclined and pivoted in the first joystick mode, the hull 2 is in a hull behavior such that the bow is turned in a direction corresponding to the pivoting direction of the joystick 8 while the hull 2 is moved in a direction corresponding to the inclination direction of the joystick 8. In general, however, maneuvering the watercraft is more easily performed by inclining the joystick 8 for the hull translation behavior (see FIG. 9A) for the adjustment of the position of the hull 2 and by pivoting the joystick 8 for the fixed-point bow turning behavior (see FIG. 9B) for the adjustment of the azimuth of the hull 2.

In the second joystick mode shown in FIG. 10, the propulsive force generated by only one of the two propulsion devices is utilized and, therefore, the hull translation (see FIG. 9A) which utilizes the resultant force of the propulsive forces of the two propulsion devices is impossible. That is, the second joystick mode is a control mode that disables a certain hull behavior (specifically, the hull translation behavior) available in the first joystick mode. In the examples shown in FIG. 9B, only the propulsive force of the electric outboard motor EM is utilized, so that the fixed-point bow turning behavior is available not only in the dual mode but also in the electric mode and the extender mode.

In the second joystick mode, the main controller 101 defines the anteroposterior inclination of the joystick 8 as the propulsive force command (the shift command and the output command), and ignores the lateral inclination of the joystick 8. That is, when the joystick 8 is inclined, only the anteroposterior directional component of the inclination direction of the joystick 8 serves as an effective input, and is defined as the propulsive force command. More specifically, if the anteroposterior directional component has a value indicating the forward inclination, the anteroposterior directional component is defined as a forward shift command. If the anteroposterior directional component has a value indicating the rearward inclination, the anteroposterior directional component is defined as a reverse shift command. Further, the magnitude of the anteroposterior directional component is defined as a command (output command) indicating the magnitude of the propulsive force. The propulsive force command (the shift command and the output command) thus defined is inputted from the main controller 101 to the remote control ECU 90 (in the engine mode) or to the motor controller 80 (in the electric mode or the extender mode). On the other hand, the main controller 101 defines the axial pivoting of the joystick 8 as the steering angle command in the second joystick mode. That is, the main controller 101 generates the steering angle command according to the axial pivoting direction and the pivoting amount of the joystick 8, and inputs the steering angle command to the remote control ECU 90 (in the engine mode) or to the steering controller 81 (in the electric mode or the extender mode).

In the engine mode, the remote control ECU 90 transmits the steering angle command and the propulsive force command to the steering ECU 41 and the engine ECU 40, respectively. Thus, the engine outboard motor OM is steered to a steering angle according to the steering angle command, and the shift position and the engine rotation speed of the engine outboard motor OM are controlled so as to generate a propulsive force according to the propulsive force command. In the electric mode or the extender mode, the motor controller 80 drives the electric motor 61 according to the propulsive force command, and the steering controller 81 drives the steering motor 74 according to the steering angle command.

The fixed point holding mode (Stay Point™), the position holding mode (Fish Point™) and the azimuth holding mode (Drift Point™) to be selected by operating the holding mode setting buttons 182, 183 and 184, respectively, are examples of the holding mode. In these holding modes, the outputs and the steering angles of the engine outboard motor OM and/or the electric outboard motor EM are controlled without any manual operation by the user.

In the fixed point holding mode (Stay Point™), for example, the main controller 101 controls the outputs and the steering angles of the engine outboard motor OM and the electric outboard motor EM based on the position data and the speed data generated by the GPS receiver 110 and the azimuth data outputted from the azimuth sensor 111. Thus, the positional change and the azimuthal change of the hull 2 are reduced. The fixed point holding mode is available in the dual mode.

In the position holding mode (Fish Point™), the main controller 101 controls the output and the steering angle of at least one of the engine outboard motor OM and the electric outboard motor EM based on the position data and the speed data generated by the GPS receiver 110. Thus, the positional change of the hull 2 is reduced.

In the azimuth holding mode (Drift Point™), the main controller 101 controls the output and the steering angle of at least one of the engine outboard motor OM and the electric outboard motor EM based on the azimuth data generated by the azimuth sensor 111. Thus, the azimuthal change of the hull 2 is reduced.

The position holding mode and the azimuth holding mode are available in any of the electric mode, the engine mode, the dual mode, and the extender mode.

In the joystick mode, the user may perform a predetermined hold operation (hereinafter referred to as "joystick hold operation") to command an operation hold mode (hereinafter referred to as "joystick hold mode") in which an operation state value (an anteroposterior operation state value in the present preferred embodiment) of the joystick 8 is maintained.

The joystick hold operation may be such that the joystick button 181 is long-pressed with the joystick 8 inclined forward or rearward. If the joystick hold operation is performed, the main controller 101 stores the anteroposterior directional component of the operation position of the joystick 8 as the operation state value in a memory 101M (see FIG. 7), and controls the propulsive forces of the engine outboard motor OM and/or the electric outboard motor EM based on the stored operation state value.

In the joystick hold mode, the main controller 101 performs the steering control operation on the engine outboard motor OM and/or the electric outboard motor EM according to the twisting operation of the joystick 8. If the joystick 8 is inclined forward or rearward in the joystick hold mode, the main controller 101 may perform an output control operation by increasing or reducing the output (the propulsive force) by a predetermined value (e.g., 10%). If the propulsive force command value becomes zero by the output control operation, the main controller 101 may cancel the joystick hold mode to return to the ordinary joystick mode. If the joystick button 181 is operated in the joystick hold mode, the main controller 101 may cancel the joystick hold mode to return to the ordinary joystick mode. If the remote control lever 7 is operated in the joystick hold mode, the main controller 101 may cancel the joystick hold mode to return to the ordinary mode.

Any of the automatic steering functions (autopilot functions) may be utilized in the joystick hold mode. That is, any one of the automatic steering functions, i.e., the azimuth maintaining function, the course maintaining function, the point-passing (Track Point) function or the pattern-sailing (Pattern Steer) function, can be commanded by operating the application switch panel 150 (see FIG. 7) while maintaining the propulsive force according to the joystick hold mode. Thus, the main controller 101 performs an automatic steering control operation in the joystick hold mode.

When the joystick hold mode is effected in the dual mode in which the propulsive forces of the engine outboard motor OM and the electric outboard motor EM are both available, the main controller 101 may perform the watercraft-maneuvering control operation by utilizing only the propulsive force of the engine outboard motor OM without driving the electric outboard motor EM. The joystick hold mode is a control mode that aims at alleviating the operation burden of the user in long-distance sailing and, therefore, it is reasonable to use the propulsive force of the engine outboard motor OM suitable for the higher-speed sailing. In this case, the main controller 101 may perform an automatic tilt-up control operation to tilt up the electric outboard motor EM to locate the propeller 60 in the above-water position, thus preventing the electric outboard motor EM from providing a sailing resistance.

FIG. 11 shows an exemplary control table to be used by the main controller 101 to control the lamps 12. As described above, the control mode of the main controller 101 is classified into the engine mode, the dual mode (hybrid mode), the electric mode, or the extender mode depending on the power supply state and the engine operation state of the engine outboard motor OM and the power supply state of the electric outboard motor EM. These modes are hereinafter sometimes referred to generally as "propulsion device mode."

On the other hand, as described above, the control mode of the main controller 101 is classified into the ordinary mode, the joystick mode, or the holding mode in terms of the operation system. These modes are hereinafter sometimes referred to generally as "watercraft maneuvering mode."

The ordinary mode is watercraft maneuvering control mode that uses the steering wheel 6 and the remote control lever 7. In this case, the electric outboard motor EM is preferably in the tilt-up state with the propeller 60 located in the above-water position so as not to provide sailing resistance. In the ordinary mode, the main controller 101 typically maintains the electric outboard motor EM in the stop state. In the present preferred embodiment, therefore, the main controller 101 controls the lamps 12 in an unlit state in the ordinary mode. The ordinary mode is an example of the electric propulsion device disabled mode in which the driving of the electric outboard motor EM is disabled. In the ordinary mode, the main controller 101 performs an indicator stopping control operation to stop the actuation (lighting) of the lamps 12.

The joystick mode is a watercraft maneuvering control mode in which the user operates the joystick 8. As described above, the joystick mode includes the ordinary joystick mode (see FIGS. 9A, 9B and 10) and the joystick hold mode, and further includes a joystick hold/automatic steering (autopilot) combination mode. The ordinary joystick mode is an example of the operation response mode in which the watercraft maneuvering control operation is performed in response to the operation of the joystick 8. The joystick hold mode is an example of the operation hold mode. The autopilot is an example of the automatic mode and, therefore, the joystick hold/autopilot combination mode can be an example of the automatic mode.

The joystick mode, when being effected in the engine mode, is regarded as the electric propulsion device disabled mode in which only the engine outboard motor OM is driven and the electric outboard motor EM is not driven. Therefore, the main controller 101 controls the lamps 12 in the unlit state without actuating (lighting) the lamps 12 (indicator stopping control operation).

The ordinary joystick mode, when being effected in the dual mode for the translation and/or the bow turning by the operation of the joystick 8, is regarded as the electric propulsion device enabled mode in which the propulsive force of the electric outboard motor EM is utilized. Therefore, the main controller 101 performs the indicator control operation to actuate (light) the lamps 12. In the joystick hold mode (or the joystick hold/autopilot combination mode), on the other hand, the main controller 101 performs the watercraft maneuvering control operation by utilizing only the propulsive force of the engine outboard motor OM as described above and, therefore, the joystick hold mode is regarded as the electric propulsion device disabled mode in which the electric outboard motor EM is in the stop state. In this case, the electric outboard motor EM is typically in the tilt-up state with the propeller 60 located in the above-water position. Therefore, the main controller 101 controls the lamps 12 in the unlit state without actuating (lighting) the lamps 12 (indicator stopping control operation).

The joystick mode, when being effected in the electric mode or the extender mode, is regarded as the electric propulsion device enabled mode in which the electric outboard motor EM is driven to solely generate the propulsive force and the engine outboard motor OM is not driven or driven not for the generation of the propulsive force. Therefore, the main controller 101 performs the indicator control operation to actuate (light) the lamps 12.

As described above, the holding mode (Set Point™) includes the fixed point holding mode (Stay Point™) in which the position and the azimuth are maintained, the position holding mode (Fish Point™) in which only the position is maintained, and the azimuth holding mode (Drift Point™) in which only the azimuth is maintained. These holding modes are examples of the automatic mode. If the holding mode is effected in the engine mode, the dual mode, the electric mode, or the extender mode, the main controller 101 performs the indicator control operation to actuate (light) the lamps 12. The holding mode effected in the dual mode, the electric mode, or the extender mode is regarded as the electric propulsion device enabled mode in which the driving of the electric outboard motor EM is enabled.

In the engine mode, the electric outboard motor EM is typically in the tilt-up state with the propeller 60 located in the above-water position. In the engine mode, which is regarded as the electric propulsion device disabled mode in which the driving of the electric outboard motor EM is disabled, the indicator control operation with the use of the lamps 12 is disabled. In the holding mode effected in the engine mode, which is regarded as the electric propulsion device disabled mode in which the driving of the electric outboard motor EM is disabled, however, the indicator control operation is performed in the present preferred embodiment. In the engine mode, of course, the engine 30 is in operation and, therefore, the operation sound and the vibrations of the engine 30 make it possible to indicate to the surroundings that the propeller 32 of the engine outboard motor OM is in the drivable state. In the holding mode effected in the engine mode, therefore, the main controller 101 may control the lamps 12 in the unlit state without actuating (lighting) the lamps 12 (indicator stopping control operation).

In the joystick mode, the lamps 12 may be continuously lit, or may be intermittently lit. In the holding mode, similarly, the lamps 12 may be continuously lit, or may be intermittently lit. The lamps 12 may be continuously lit in the joystick mode, and may be intermittently lit in the holding mode. In the holding mode, the electric outboard motor EM is intermittently driven and, therefore, the intermittent lighting of the lamps 12 makes it possible to properly indicate to the surroundings about the driving state of the electric outboard motor EM.

The control table of FIG. 11 shows, in another aspect, that the main controller 101 enables the indicator control operation to light the lamps 12 when the electric outboard motor EM is brought into the tilt-down state with the propeller 60 located in the underwater position. Further, when the electric outboard motor EM is brought into the tilt-up state with the propeller 60 located in the above-water position, the main controller 101 disables the indicator control operation to control the lamps 12 in the unlit state. In the engine mode, however, the main controller 101 may exceptionally light the lamps 12 in order to indicate that the holding mode is effected, even if the propeller 60 of the electric outboard motor EM is in the above-water position.

Figure 12:
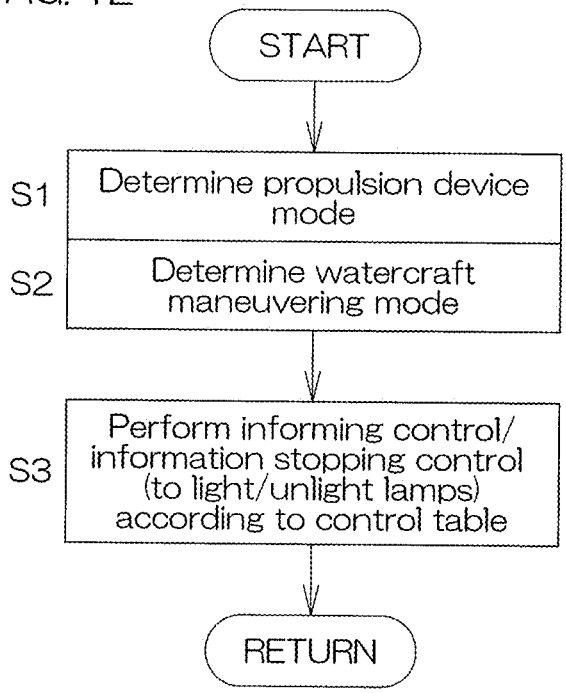
FIG. 12 is a flowchart for describing an exemplary lamp control operation to be performed by a main controller.

FIG. 12 is a flowchart for describing an exemplary control operation to be performed in relation to the actuation of the lamps 12 by the main controller 101. The main controller 101 checks the current control mode. That is, the main controller 101 determines which propulsion device mode (the engine mode, the dual mode, the electric mode, or the extender mode) the current control mode belongs to (Step S1) and determines which watercraft maneuvering mode (the ordinary mode, the joystick mode, or the holding mode) the current control mode belongs to (Step S2). Based on the determination results, the main controller 101 performs the indicator control operation to light the lamps 12 or performs the indicator stopping control operation to unlight the lamps 12 according to the control table shown in FIG. 11 (Step S3).

According to the present preferred embodiment, as described above, when the control mode of the main controller 101 is the electric propulsion device enabled mode, the main controller 101 lights the lamps 12 to indicate to the surroundings that the electric outboard motor EM is in the drivable state. By thus lighting the lamps 12, not only the driving state of the electric outboard motor EM but also the drivable standby state of the electric outboard motor EM are visible to the surroundings (particularly, by the user of another watercraft sailing there behind). Since the lamps 12 are disposed above the draft line 11 of the hull 2, the optical signals outputted from the lamps 12 are easily visible to the surroundings such that the indicator control operation is effectively performed. Particularly, the lamps 12 emit light rearward of the hull 2. That is, the lamps 12 emit light in the direction of the stern 3 on which the electric outboard motor EM is provided. Thus, indicator information is properly provided to the surroundings of the electric outboard motor EM (particularly, to the user of the watercraft sailing behind).

In the electric propulsion device disabled mode in which the propulsive force generation by the engine outboard motor OM is enabled but the driving of the electric outboard motor EM is disabled, on the other hand, the main controller 101 does not light the lamps 12. Thus, the indicator control operation is prevented from being uselessly performed and, when needed, is performed by lighting the lamps 12. Thus, the indicator control operation can be effectively performed.

As described above, the main controller 101 does not light the lamps 12 when the propeller 60 of the electric outboard motor EM is located in the above-water position, but enables the indicator control operation to light the lamps 12 when the propeller 60 is located in the underwater position. Thus, the indicator control operation is prevented from being uselessly performed and, when needed, is performed by lighting the lamps 12. Thus, the indicator control operation can be effectively performed.

In the present preferred embodiment, the main controller 101 lights the lamps 12 in the joystick mode in which the electric outboard motor EM can be driven in response to the operation of the joystick 8. Thus, the indicator information is properly provided to the surroundings. In the automatic mode such as the holding mode, the main controller 101 lights the lamps 12 (e.g., intermittently lights the lamps 12), so that the indicator information is properly provided to the surroundings.

While preferred embodiments of the present invention have thus been described, the present invention may be embodied in some other ways.

In a preferred embodiment described above, the lamps 12 are attached as the indicator to the hull 2 by way of example, but such a lamp may be attached to the electric outboard motor EM. The attachment position is preferably above the draft line 11 of the hull 2.

In a preferred embodiment described above, the optical signals outputted from the lamps 12 are used as the indicator signal. An indicator that is able to output a sound signal may be used instead of the lamps 12, or may be used in combination with the lamps 12.

Further, the main propulsion device is not necessarily required to be the engine propulsion device adapted to be driven by the engine, but an electric propulsion device having a relatively high output may be used as the main propulsion device. Similarly, the auxiliary propulsion device is not necessarily required to be the electric propulsion device, but an engine propulsion device having a relatively low output may be used as the auxiliary propulsion device. Further, the watercraft propulsion system may include two or more main propulsion devices. Similarly, the watercraft propulsion system may include two or more auxiliary propulsion devices. Further, the number of the propulsion devices attachable to the hull may be one.

The electric propulsion device is not necessarily required to be attachable to the stern, but an electric propulsion device such as a trolling motor may be attached to the bow or another portion of the hull.

In a preferred embodiment described above, the outboard motors are used as the propulsion devices by way of example, but inboard motors, inboard/outboard motors (stern drives), waterjet propulsion devices and other types of propulsion devices may be used.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft propulsion system comprising:

an electric propulsion device attachable to a hull and including a propeller to be located at an underwater position below a draft line of the hull;

a lift to move up and down the propeller of the electric propulsion device between the underwater position and an above-water position above the draft line of the hull;

an indicator provided on the hull and directly attached to the hull such that the indicator is located above the draft line of the hull even when the propeller is located at the underwater position and operable to indicate to surroundings of the electric propulsion device information about a state of the electric propulsion device; and a controller including a plurality of control modes including an electric propulsion device enabled mode in which the electric propulsion device is enabled to be driven, and configured or programmed to perform an indicator control operation in the electric propulsion device enabled mode to actuate the indicator to indicate that the electric propulsion device is in a drivable state.

2. The watercraft propulsion system according to claim 1, further comprising:

an engine propulsion device attachable to the hull; wherein the plurality of control modes further include an electric propulsion device disabled mode in which the engine propulsion device is enabled to generate a propulsive force and the electric propulsion device is disabled from being driven; and the controller is configured or programmed to perform an indicator stopping control operation in the electric propulsion device disabled mode to stop the actuation of the indicator.

3. The watercraft propulsion system according to claim 1, wherein the controller is configured or programmed to enable the indicator control operation when the propeller is in the underwater position, and to disable the indicator control operation when the propeller is in the above-water position.

4. The watercraft propulsion system according to claim 1, further comprising:

an operator operable by a user to maneuver the hull; wherein the electric propulsion device enabled mode includes an operation response mode in which the controller drives the electric propulsion device in response to the operation of the operator.

5. The watercraft propulsion system according to claim 4, wherein the electric propulsion device enabled mode further includes an operation hold mode in which an operation state value indicating an operation state of the operator is stored and the controller is configured or programmed to drive the electric propulsion device according to the stored operation state value.

6. The watercraft propulsion system according to claim 4, wherein the electric propulsion device enabled mode further includes an automatic mode in which a hull behavior is controlled without operating the operator.

7. A watercraft propulsion system comprising:

an electric propulsion device attachable to a hull and including a propeller to be located at an underwater position below a draft line of the hull;

a lift to move up and down the propeller of the electric propulsion device between the underwater position and an above-water position above the draft line of the hull; and an indicator provided on the hull and directly attached to the hull such that the indicator is located above the draft line of the hull even when the propeller is located at the underwater position and operable to indicate to surroundings of the electric propulsion device that the electric propulsion device is in a drivable state.

8. The watercraft propulsion system according to claim 7, further comprising an engine propulsion device attachable to the hull.

9. The watercraft propulsion system according to claim 8, wherein the electric propulsion device and the engine propulsion device are provided side by side on a stern of the hull; and the indicator is operable to generate an indicator signal that is recognizable from a rear side of the hull.

10. A watercraft comprising:

a hull; and the watercraft propulsion system according to claim 1 provided on the hull.

11. A watercraft comprising:

a hull; and the watercraft propulsion system according to claim 7 provided on the hull.

* * * * *